US007028790B2

(12) United States Patent
Moore

(10) Patent No.: US 7,028,790 B2
(45) Date of Patent: Apr. 18, 2006

(54) ROTARY DRILL BIT

(75) Inventor: John F. Moore, Westminster, MA (US)

(73) Assignee: Jack Moore Associates, Inc., Worcester, MA (US)

( * ) Notice: Subject to any disclaimer, the term of this patent is extended or adjusted under 35 U.S.C. 154(b) by 179 days.

(21) Appl. No.: 10/665,596

(22) Filed: Sep. 19, 2003

(65) Prior Publication Data

US 2005/0061552 A1 Mar. 24, 2005

(51) Int. Cl.
*E21B 10/26* (2006.01)

(52) U.S. Cl. ..... 175/385; 175/334; 175/395; 175/403; 299/41; 408/202; 408/241; 404/75; 404/90

(58) Field of Classification Search ..... 408/202, 408/241 S; 404/9, 75, 72, 12, 13, 90, 14; 175/30, 330, 329, 340, 385, 327, 334, 395, 175/402, 403, 393; 299/41
See application file for complete search history.

(56) References Cited

U.S. PATENT DOCUMENTS

| | | | | |
|---|---|---|---|---|
| 134,506 | A | 1/1873 | Ball | 175/326 |
| 2,225,193 | A | 12/1940 | Benner et al. | 451/542 |
| 2,475,812 | A | 7/1949 | Alsup | |
| 2,978,846 | A | 4/1961 | Barron | 451/541 |
| 2,996,061 | A * | 8/1961 | Miller | 408/59 |
| 3,301,101 | A | 1/1967 | McEwen | |
| 3,966,349 | A | 6/1976 | Osman et al. | 408/204 |
| 4,244,667 | A | 1/1981 | Timmons | 408/201 |
| 4,616,964 | A | 10/1986 | Nomura | 408/144 |
| 4,762,445 | A | 8/1988 | Bunting et al. | 408/144 |
| 4,907,662 | A | 3/1990 | Deane et al. | 175/329 |
| 5,009,553 | A | 4/1991 | Nowman | 408/1 R |
| 5,069,584 | A | 12/1991 | Obermeier et al. | 408/145 |
| 5,158,393 | A | 10/1992 | Bossler | 404/9 |
| 5,252,009 | A | 10/1993 | Bossler | 408/145 |
| 5,265,988 | A | 11/1993 | Schmigalla et al. | 408/225 |
| 6,029,544 | A | 2/2000 | Katayama | 76/108.6 |
| 6,032,750 | A | 3/2000 | Kersten et al. | 175/398 |
| 6,412,579 | B1 * | 7/2002 | Fielder | 175/385 |
| 6,481,937 | B1 | 11/2002 | Sommerfeld et al. | |
| 6,564,887 | B1 | 5/2003 | Hong et al. | 175/395 |

FOREIGN PATENT DOCUMENTS

| | | |
|---|---|---|
| DE | 36 39 107 | 5/1988 |
| FR | 684 634 | 6/1930 |
| GB | 2 196 277 | 4/1988 |

* cited by examiner

*Primary Examiner*—Jennifer H. Gay
*Assistant Examiner*—Nicole A Coy
(74) *Attorney, Agent, or Firm*—Fish & Richardson P.C.

(57) ABSTRACT

A drill bit includes a body defining an axis and first and second cylindrical portions, a coupling adapted for connection with a rotary driver, and a depth stop adjustably secured to a first portion by a plurality of adjusting fasteners in a manner to limit penetration of the bit into a target surface. A method of drilling a hole into the surface includes locating a drilling machine fitted with a drill bit over a target location, compensating for wear on the bit by setting a depth stop to limit travel of the bit at the predetermined depth, drilling at the target location until the depth stop contacts a surface, where the primary cutting surface forms a portion of the hole defined by a first diameter and the secondary cutting surface forms a portion of the hole defined by a second diameter in a single step, and removing the drill bit from the hole.

7 Claims, 6 Drawing Sheets

ROTARY DRILL BIT

TECHNICAL FIELD

This invention relates to devices and methods for drilling a hole in a surface, and more particularly to devices and methods for the installation of reflective markers in surfaces.

BACKGROUND

Reflective highway markers including glass and plastic reflectors are utilized in applications such as marking curbs and delineating travel lanes on roadways. For installation, some markers require drilling and coring a receiving hole of predetermined depth and diameter into a surface with a surrounding seat having a greater diameter than the receiving hole, for flush mounting of the marker. Moreover, these markers may be securely installed without the use of adhesives if the depth and diameters of the receiving hole are appropriately sized to the markers.

One approach to providing receiving holes for these markers is the use of drill bits that create a surrounding seat but leave a core that has to be broken away. This necessitates multiple steps and also often results in a hole with an irregular bottom surface having an incorrect depth. Consequent improper installation of the marker can result in premature failure.

SUMMARY

In one aspect of the invention, a drill bit includes a body, a coupling, and a depth stop. The body defines an axis and includes a proximal end and a distal end with a closed face. The body also includes a first portion adjacent to the proximal end and a second portion adjacent to the distal end, with both portions being substantially cylindrical. A first outer diameter of the first portion is greater than a second outer diameter of the second portion. The coupling is adapted for connection with a rotary driver. In some embodiments, the coupling is threadably connected to the rotary driver. In other embodiments, the coupling is a Bantam™ coupling. The depth stop is located between the first portion and the distal end circumferentially around the second portion. The depth stop is adjustably secured to the first portion by a plurality of adjusting fasteners in a manner to limit penetration of the bit. In some embodiments, the adjusting fasteners are screws that are substantially parallel to the axis. In other embodiments, the depth stop is substantially disk shaped. In these embodiments, the drill bit may also include a stop outer diameter approximately equal to the first outer diameter, and a stop inner diameter slightly greater than the second outer diameter.

In one embodiment, the drill bit also includes a primary cutting surface substantially located on the closed face with at least one outer cutter segment, and a secondary cutting surface substantially located on a portion of the body with a diameter greater than a diameter of the closed face. In one embodiment, the outer cutter segment is a plurality of outer cutter segments spaced around a circumference of the closed face and may include one or more inner cutter segments extending across the closed face. In various embodiments, the cutting surfaces these outer and inner cutter segments may be water cooled. In a preferred embodiment, the first outer diameter is approximately thirty-three percent greater than the second outer diameter. In one preferred embodiment, the first outer diameter is between about 1.9 and 2.7 inches and the second outer diameter is between about 1.5 and 2.1 inches.

In one embodiment, the drill bit also includes an intermediate ring extending radially outward circumferentially about the second portion to provide centering. Preferably, the secondary cutting surface is substantially located on the intermediate ring. In a preferred embodiment, an outer diameter of the intermediate ring is between about 1.9 and about 2.3 inches. Other suitable dimensions for marker installation are contemplated. The drill bit may also include a pilot drill extending axially from the distal end of the body. In some embodiments, the pilot drill is tipped by a diamond or a carbide cutter tip. The pilot drill cutter tip can also be water cooled.

In another aspect of the invention, a bit includes a body, a coupling at the proximal end, a depth stop, primary and secondary cutting surfaces, and a pilot drill. The body defines an axis and includes a distal end with a closed face and a proximal end. The body also includes a first portion adjacent to the proximal end, a second portion adjacent to the distal end, and an intermediate ring. The portions are substantially cylindrical and the first portion includes external threads. The intermediate ring extends radially outward circumferentially about the second portion. The coupling is threaded to be connected to a rotary driver. The depth stop includes first internal threads and is adjustably secured to the first portion by engagement of the first internal threads and the external threads of the first portion. Moreover, the depth stop is adjustably located between the proximal end and the second portion circumferentially around the first portion in a manner to limit penetration of the bit. The primary cutting surface is substantially located on the closed face. The primary cutting surface includes a plurality of outer cutter segments spaced around a circumference of the closed face and at least one inner cutter segment extending across the closed face. The secondary cutting surface is substantially located on the intermediate ring. The pilot drill extends axially from the distal end of the body and is tipped by a cutter tip.

In one embodiment, the drill bit also includes a locking ring with internal threads. The locking ring can be adjustably secured to the first portion by engagement of the its internal threads and the external threads of the first portion. In some embodiments, the locking ring is adjustably located between the proximal end and the second portion circumferentially around the first portion. In one embodiment, the cutter segments are water cooled. In another embodiment, the drill bit includes one or more internal cooling channels extending longitudinally along the bit.

In another aspect of the invention, a method of drilling a hole in a surface includes locating a drilling machine having a drill bit over a target location, compensating for wear on the drill bit, operating the drilling machine to drill into a surface at the target location, and removing the drill bit from the hole. The hole is defined by a predetermined depth, a first diameter, and a different second diameter. The drilling machine is constructed in a manner to drill and core a hole having two different diameters in a single operation. Compensating for wear on the drill bit to maintain consistent hole depth bit is accomplished by setting a depth stop on the bit or setting a depth stop on the drilling machine to limit travel of the drill bit at the predetermined depth. While the drill bit is drilled into the surface and until the depth stop contacts a perimeter surface of the target location, the primary cutting surface forms a portion of the hole defined by the first diameter, and the secondary cutting surface forms a portion of the hole defined by the second diameter in one step.

In one embodiment, the method also includes connecting a water source to the drilling machine prior to operating the machine, cooling the cutting surfaces with flow of water, and removing the resulting slurry water from the hole after removing the drill core bit from the hole. Preferably, the method includes fastening the drilling machine either to the surface or to a stand which is weighted to stabilize the drilling machine.

In another aspect of the invention, a method of installing a marker in a surface includes locating a drilling machine having a drill bit over a target location, drilling and coring a hole having two different diameters in a single operation, compensating for wear on the drill bit by setting a depth stop to limit travel of the drill bit at a predetermined depth, operating the drilling machine to drill the drill bit into the surface at the target location, removing the drill bit from the hole, and installing the marker into the hole. While the drill bit is drilled into the surface at the target location until the depth stop contacts a surface of the target location, the primary cutting surface forms a portion of the hole defined by a first diameter and the secondary cutting surface forms a portion of the hole defined by a second diameter in one step. The marker can be installed marker flush with the surface.

The method can include connecting a water source to the drilling machine prior to operating the machine, cooling the cutting surfaces with flow of water, and removing the resulting slurry water from the hole after removing the drill bit from the hole.

The method can also include either fastening the drilling machine to the surface or to a stand which is weighted to stabilize the drilling machine. The installed marker can be a reflective highway marker secured in place after installation by a pressure-fit owing to compression of the marker by the sides defining the hole. The marker can be installed by pushing the marker into the hole.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
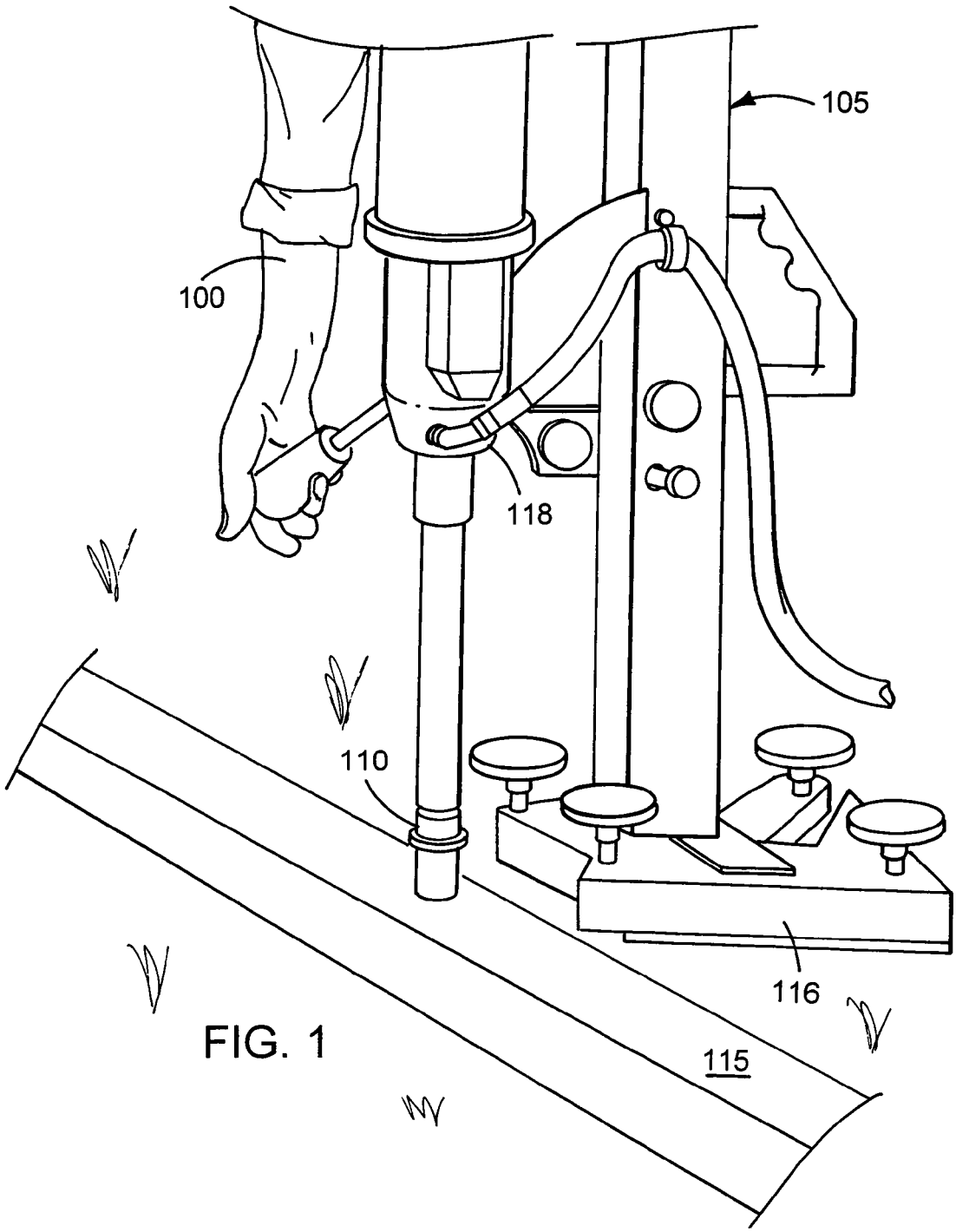
FIG. 1 is a schematic perspective view of a user operating a drilling machine equipped with a rotary drill bit.

Referring to FIG. 1, a user 100 operates a drilling machine 105 fitted with a rotary drill bit 110 for drilling into a surface (such as, for example, a curb) 115. The drilling machine 105 can include a stand 116 and a prime mover 118 for rotation of the bit 110. The user 100 is drilling into curb 115 to prepare for installation of a marker (not shown). Markers, including glass and plastic reflectors, can be utilized in applications such as illuminating curbs and delineating lanes in roadways.

Figure 2A:
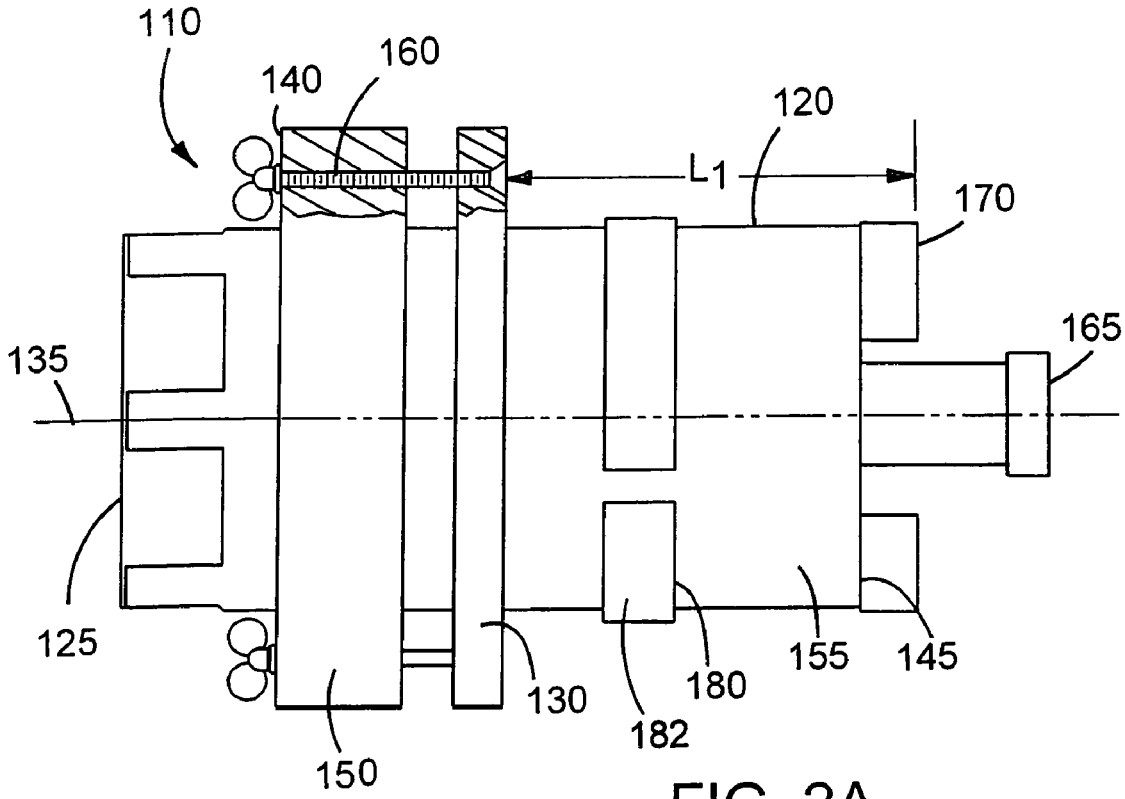
FIG. 2A is a side view of a rotary drill bit having a depth stop positioned by adjustable fasteners according to the invention.
Figure 2B:
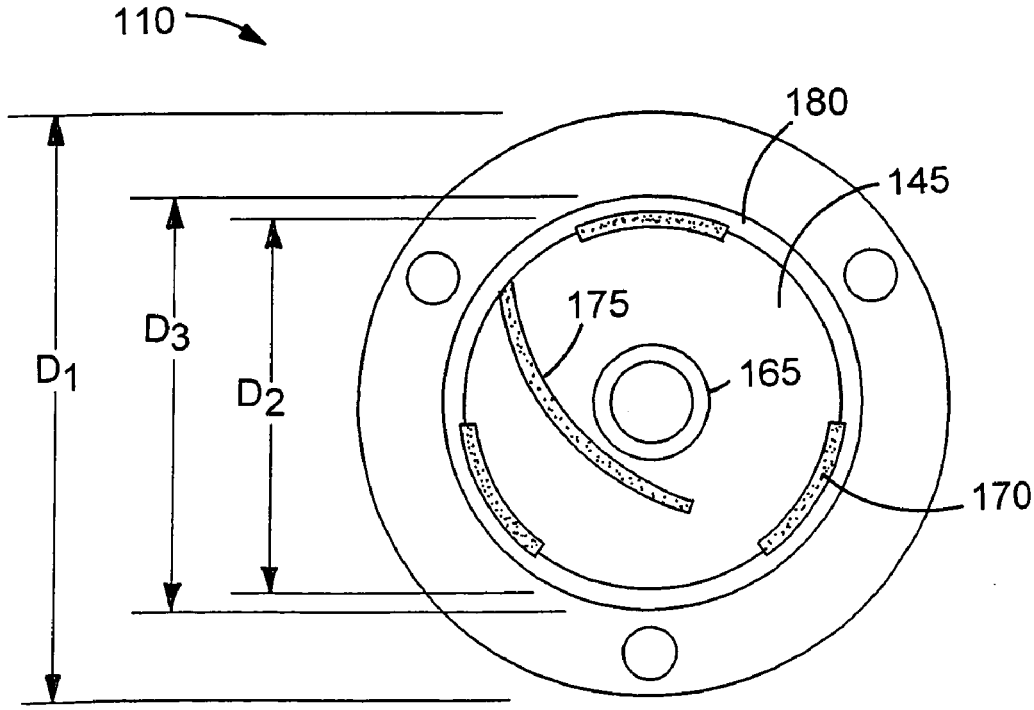
FIG. 2B is an end view of the rotary drill bit of FIG. 2A.

Referring to FIGS. 2A and 2B, the drill bit 110 according to a preferred embodiment includes a body 120, a coupling 125, and a depth stop 130. The body 120 defines an axis 135 extending longitudinally along the bit 110. The body 120 includes a proximal end 140 and a distal end 145 having a closed face as well as a first portion 150 adjacent to the proximal end 140 and a second portion 155 adjacent to the distal end 145. The first and second portions 150, 155 are substantially cylindrical. In one embodiment, the outer diameter $D_1$ of the first portion 150 is about 2.1 inches or approximately thirty-three percent greater than the outer diameter $D_2$ of the second portion 155 which is about 1.7 inches.

In some embodiments, the coupling 125 is a Bantam™ coupling and releasably attaches the drill bit 110 to the drilling machine 105. However, those skilled in the art will recognize that other couplings suitable for connection with a rotary driver can be used in place of the Bantam™ coupling shown. For example, a threaded coupling can also be used to attach the drill bit 110 to the drilling machine 105.

With continued reference to FIGS. 2A and 2B, the depth stop 130 can be located between the first portion 150 and the distal end 145. In one embodiment, the depth stop 130 is adjustably secured to the first portion 150 by screws 160 which are substantially parallel to the axis 135. The depth stop 130 allows a user to compensate for wear on the cutter segments 170 by setting the depth stop 130 along the second portion 155 to maintain a length $L_1$ corresponding to a predetermined drilling depth. This facilitates drilling a receiving hole of appropriate depth and dimensions to properly seat a marker into the surface. In some applications, the marker may be installed flush with the surface, while in other application, the marker may project slightly above the surface.

In one embodiment, the drill bit 110 includes three cutting surfaces: a pilot drill 165, primary cutting surfaces 170, 175, and a secondary cutting surface 180. The primary cutting surfaces 170, 175 are substantially located on the closed face of the distal end 145. The primary cutting surfaces 170, 175 can include three outer cutter segments 170 spaced around a circumference of the closed face of the distal end 145 and one inner cutter segment 175 extending across the closed face of the distal end 145. The secondary cutting surface 180 extends from an intermediate ring 182 extending radially outward from the second portion 155 of the body 120. In one embodiment, an outer diameter $D_3$ of the intermediate ring 182 is about 2.1 inches. The pilot drill 165 extends longitudinally along the axis 135 from the distal end 145 of the body 120 and is tipped by a cutter tip. In various embodiments, the primary cutting surfaces 170, 175, and secondary cutting surface 180, are diamond or carbide segments brazed onto the drill bit 110. Synthetic diamond materials are also contemplated for the cutter segments 170, 175, 180. The cutter tip of the pilot drill 165 can be made from diamond, synthetic diamond or carbide materials.

Figure 3:
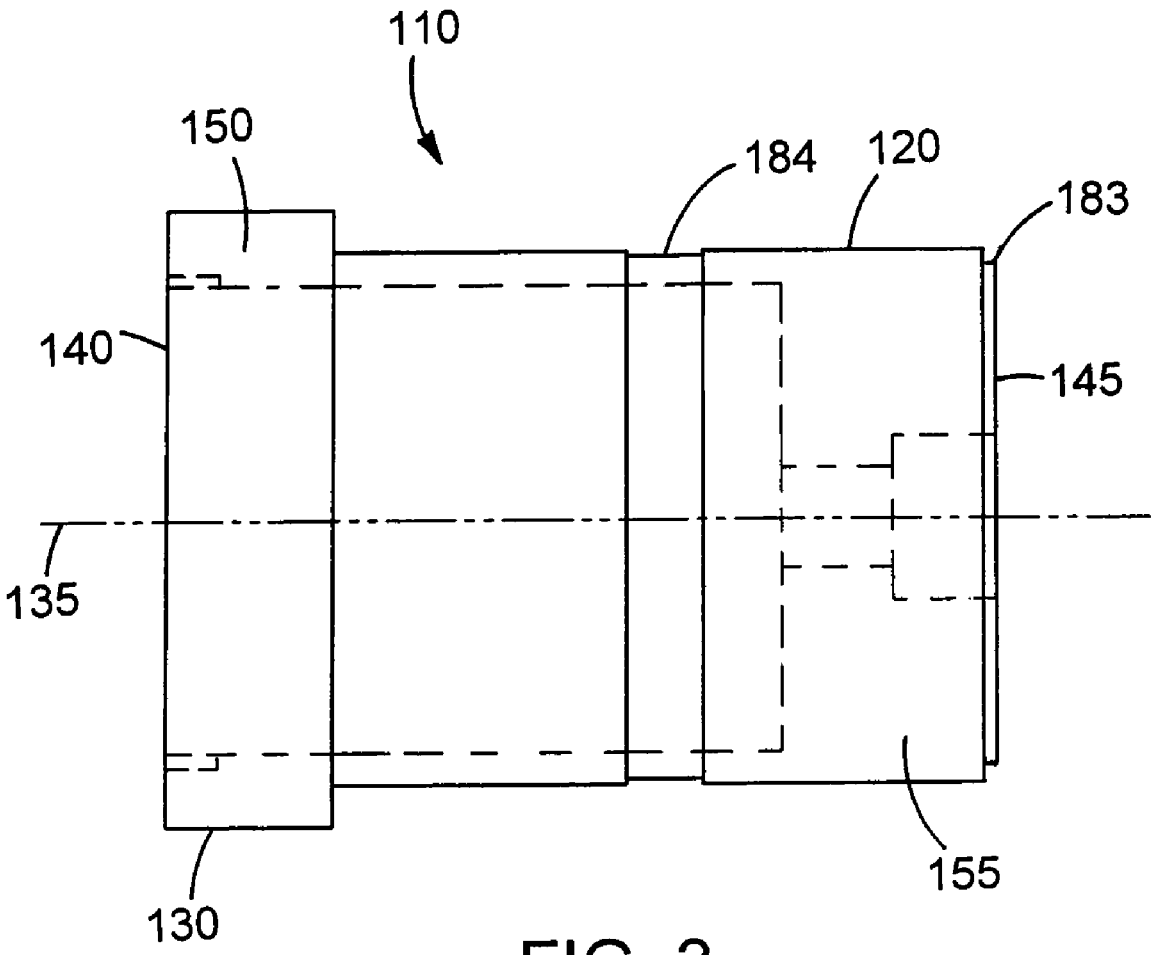
FIG. 3 is a sectional view of a portion of the drill bit of FIG. 2A with the cutting surfaces removed.

Referring to FIG. 3, in one embodiment, a step 183 is machined around the closed face of the distal end 145 of the bit 110 for positioning the cutter segments 170, 175. In one embodiment the step is about 0.08 inches along the axis 135 and about 0.15 inches transverse to the axis 135. In one embodiment, the cutting surfaces 170, 175 are brazed onto the step 183. The step 183 facilitates alignment of the cutter segments 170, 175 and can reveal increased brazing surface area for added strength. In other embodiments, the cutter segments 170, 175 are attached directly to the closed face of the distal end 145. In one embodiment the drill bit 110 is hollowed out to reduce the weight and rotational inertia of the bit. In one embodiment, a slot 184 is machined around the drill for attaching the intermediate ring 182 by brazing or other means. In other embodiments, the intermediate 182 is attached directly to the surface of the bit 110.

Figure 4:
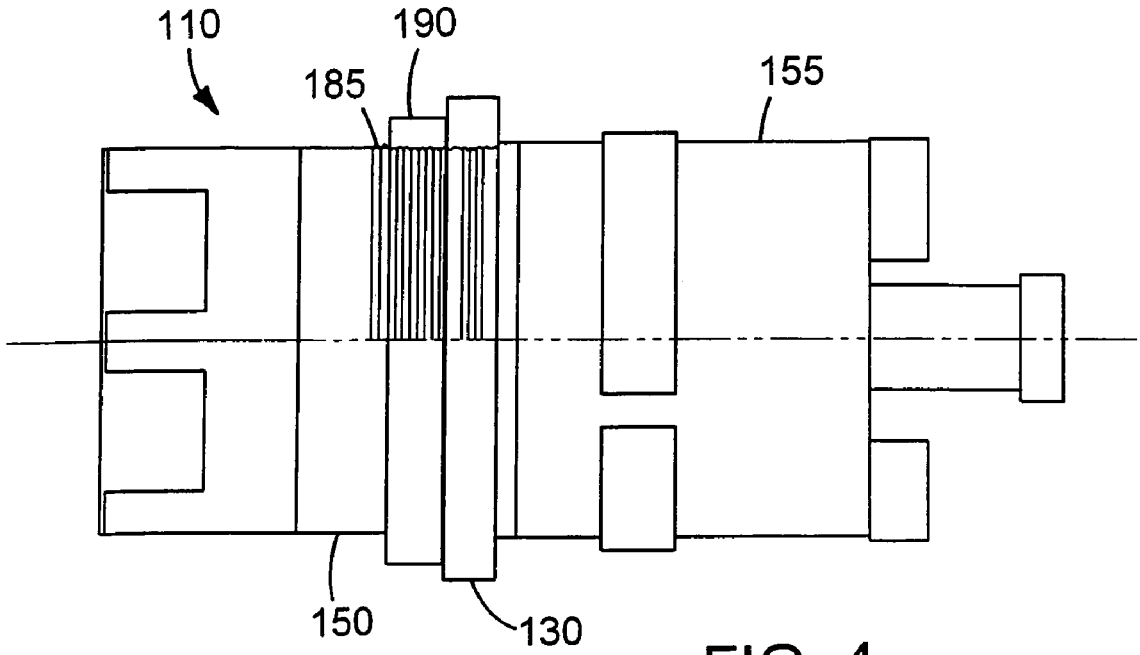
FIG. 4 is a side view of a rotary drill bit having a threaded depth stop.

FIG. 4 depicts the diamond core bit 110 with a threaded depth stop 130. Many of the features of this drill bit are similar to those of the drill bit shown in FIGS. 1 to 2B and discussed above. However, in this drill bit, the first portion 150 includes corresponding external threads 185 and the depth stop 130 includes internal threads. The depth stop 130 is adjustably rotated along the first portion 150 by engagement of the internal threads of depth stop 130 with the external threads 185 of the first portion 150. The drill bit 110 also includes a locking ring 190 with internal threads. The locking ring 190 is adjustably rotated along the first portion 150 by engagement of its internal threads with the external threads 185 of the first portion 150. The depth stop 130 is fixed in place along the first portion 150 by tightening the locking ring 190 against an adjacent edge of the depth stop 130.

Figure 5:
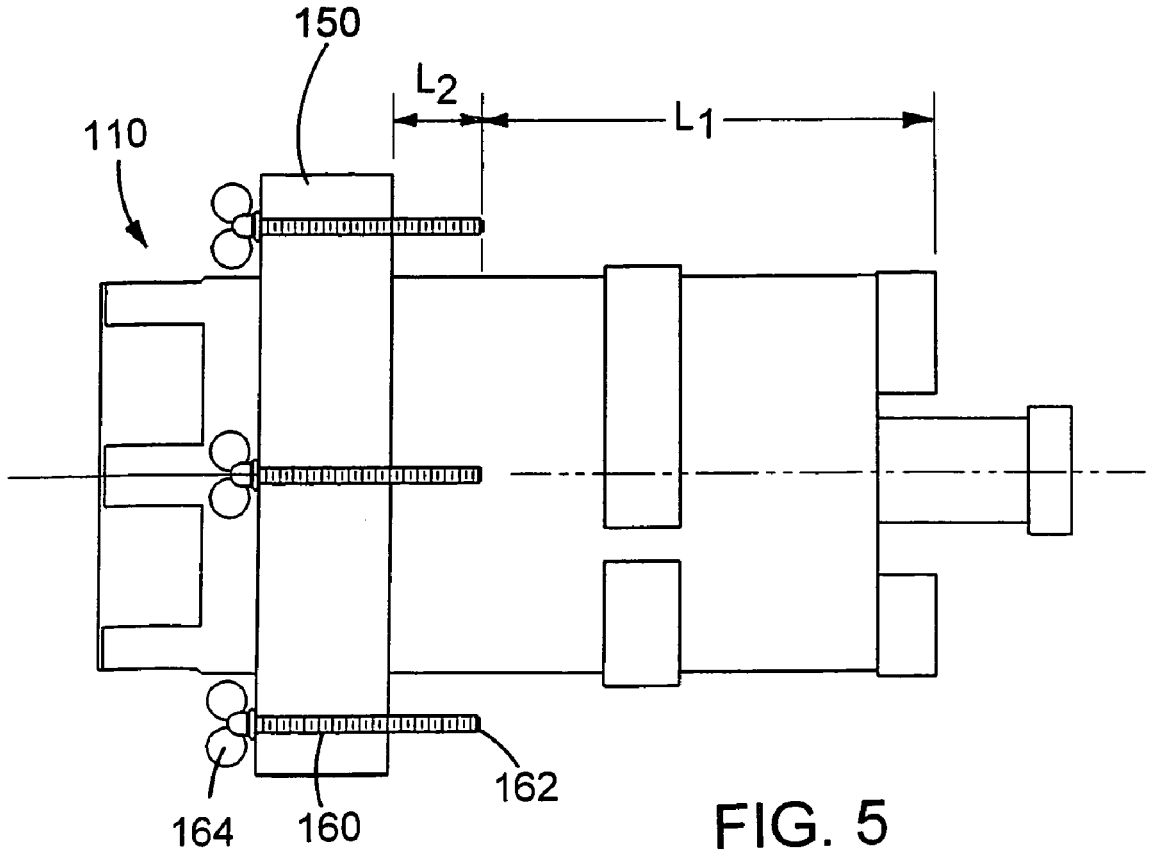
FIG. 5 is a side view of a rotary drill bit having a depth stop which includes a plurality of adjustable screws.

FIG. 5 shows a drill bit having a depth stop 130 which includes a plurality of adjustable screws 160, having threaded ends 162 which extend beyond the first portion 150 a length $L_2$ to limit penetration of the bit 110 into the surface 115. The screws 160 can include heads 164 to allow the user 100 to readily adjust the extension of the screws 160 beyond proximal end 140 and accordingly, the length $L_2$. By adjusting the length $L_2$, the available length $L_1$ is likewise adjusted, corresponding to a predetermined drilling depth.

Figure 6B:
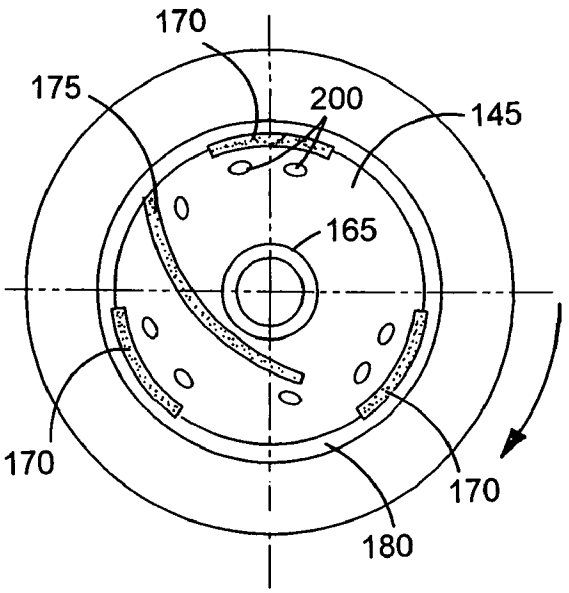
FIG. 6B is an end view of the rotary drill bit of FIG. 6A.
Figure 6A:
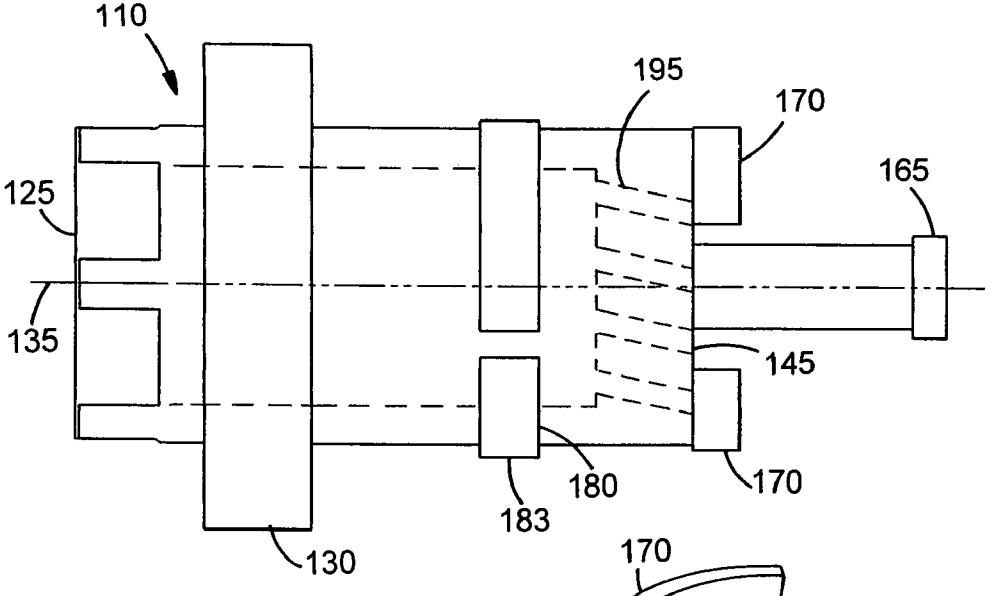
FIG. 6A is a side view of a rotary drill bit having internal channels extending longitudinally along the bit.
Figure 6C:
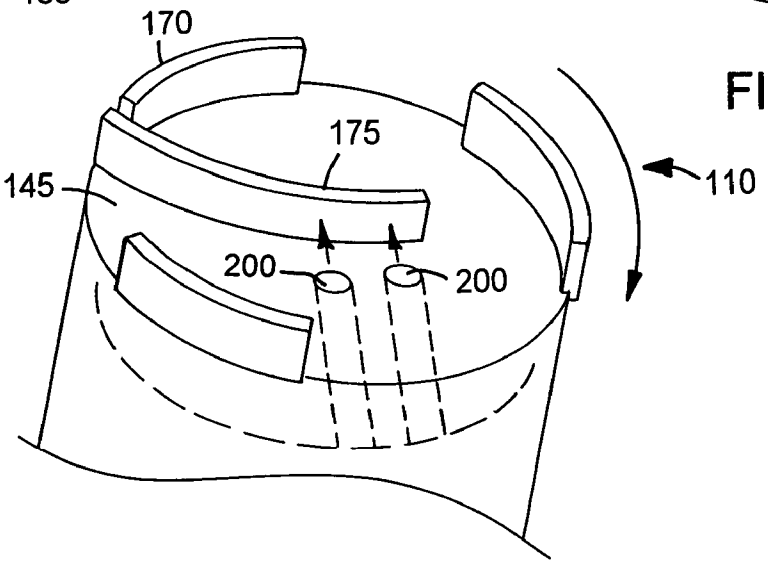
FIG. 6C is a perspective view of the rotary drill bit of FIG. 6A.

Referring to FIGS. 6A and 6C, the cutting surfaces of drill bit 110 can be externally water cooled as shown in this alternative embodiment. Water (or other suitable cooling fluid) is introduced into the coupling 125 of the drill 110 to cool the cutting surfaces 170, 175, 180 and carry away debris, thus extending the operational life of the cutting surfaces 170, 175, 180. The drill bit 110 includes internal cooling channels 195 extending longitudinally along the bit 110. The cooling channels open 195 to coolant ports 200 on the closed face of the distal end 145. In one embodiment, the cooling channels 195 are angled such that the cooling fluid exits the closed face 145 opposite the direction of rotation of the drill bit 110. In one preferred embodiment, the cooling channels 195 are angled between about thirty and fifty degrees from the axis 135. In one embodiment, the drill bit 110 includes between about four and twelve coolant ports 200 on the closed face of the distal end 145.

Figure 7:
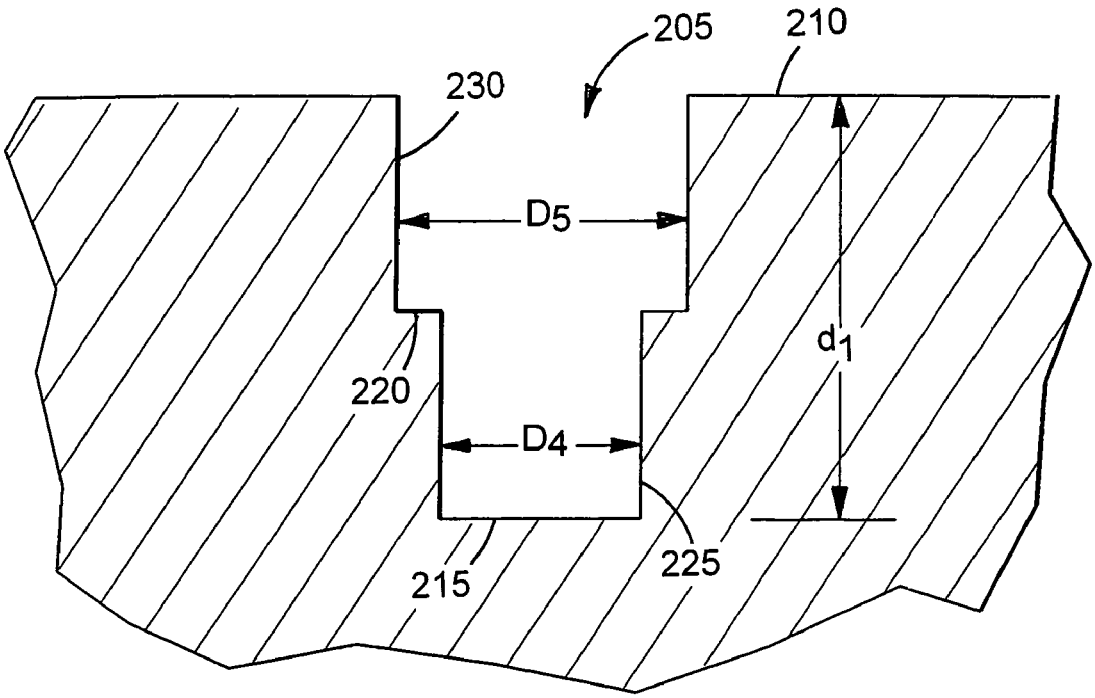
FIG. 7 is a cross-section of a two-diameter hole prepared using the rotary drill bit.
Figure 8:
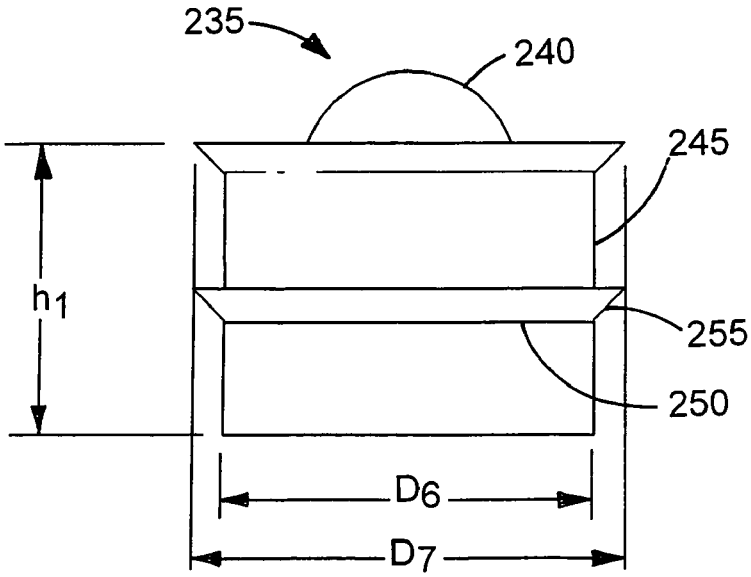
FIG. 8 is a side view of an exemplary reflective highway marker suitable for installation using the rotary drill bit.

Referring to FIGS. 7 and 8, the drill bit 110 can be used to drill a hole 205 into the surface 210 for installation of a marker 235. The hole is defined by a bottom 215, a surrounding seat 220, first sidewalls 225, and second sidewalls 230. A depth d, first diameter $D_4$, and second diameter $D_5$ of the hole 205 are sized to receive the marker 235 such that the marker is seated into the surface 210. The depth $d_1$ corresponds to the length $L_1$ of the bit 110 (FIGS. 2A and 4). Exemplary marker 235 includes a toughened glass reflector 240 and a body 245 with a bottom 250 and a seating ring 255 that define a height $h_1$, lower diameter $D_6$, and upper diameter $D_7$. After installation, the exemplary marker 235 slightly protrudes from the surface 210. It is envisioned that the claimed devices can be also used to drill receiving holes 205 for other suitable applications. In one embodiment, water is introduced to the drill bit 110 from the drilling machine 105 through the coupling 125 and along the channels 195 through the coolant ports 200 to the primary cutting surfaces 170, 175, 180. The flow of water from the channels 195 cools the cutting surfaces and carries away debris thereby extending the life of the cutting surfaces 170, 175, 180.

With renewed reference to FIGS. 2A and 2B and continued reference to FIGS. 7, and 8, the combination of the primary cutting surfaces 170, 175 and the secondary cutting surface 180 with the depth stop 130 allows the user 100 to drill a hole 205, defined by a predetermined depth $d_1$, a first diameter $D_4$, and a different second diameter $D_5$, into a surface 210. The drilling machine 105 drills and cores a hole 205 into a target location such that the depth stop 130 contacts the surface 210 (FIG. 7) of the target location, the primary cutting surfaces 170, 175 form a portion of the hole defined by the first diameter $D_4$ and the secondary cutting surface 180 forms a portion of the hole defined by the second diameter $D_5$.

In operation, the user 100 locates the drilling machine 105 including the drill bit 110, which can be constructed in a manner to drill and core two different diameters in a single operation, at a target location. This increases efficiency as well as providing a more uniform hole 205 by eliminating a core that needs to be broken away and removed from the hole in a subsequent step. The user 100 then compensates for wear on the diamond core bit 110 by setting a depth stop 130 to limit travel of the drill bit 110 at the predetermined depth $d_1$. The user 100 then operates the drilling machine 100 to drill the drill bit 110 into the surface 210 at the target location until the depth stop 130 contacts the surface 210 of the target location with the primary cutting surfaces 170, 175 forming a portion of the hole 205 defined by the first diameter $D_4$ and the secondary cutting surface 180 forming a portion of the hole 205 defined by the second diameter $D_5$ in one step. After the depth stop 130 contacts the surface 210, the core bit 110 is removed to reveal the hole 205 having a depth $d_1$ and two diameters $D_4$, $D_5$.

In an alternate method of operation, a user 100 installs a marker, such as the marker 235 shown in FIG. 8, in a surface 210. The user 100 locates a drilling machine 105 having a drill bit 110 over a target location and compensates for wear on the cutting surfaces 170, 175 of the drill bit 110 by setting a depth stop 130 a length $L_1$ away from distal end 145 (FIGS. 2A and 5) to stop travel of the drill bit 110 at a predetermined depth $d_1$. The user 100 then drills and cores a hole 205 having two different diameters $D_4$, $D_5$ in a single operation, a primary cutting surface forming a portion of the hole 205 defined by a first diameter $D_4$ and a secondary cutting surface forming a portion of the hole 205 defined by a second diameter $D_5$ in one step. The user 100 then removes the drill bit 110 from the hole 205, and installs the marker 235 into the hole 205. The marker 235 can be a reflective marker held in place after installation by compression of the marker 235 along sides 225, 230 defining the hole 205. Accordingly, the user 100 pushes the marker 235 into the hole 205 to form a resilient pressure-fit for secure installation of the marker 235 into the surface 210. This method can include installing the marker 235 flush with or raised above the surface 210.

When using a drill bit 110 that is water cooled, the two methods described above can also include the steps of connecting a water source to the drilling machine 105 prior to operating the drilling machine 105 cooling the cutting surfaces 170, 175, 180 with a flow of water and removing the slurry water from the hole 205 after removing the diamond core bit 110 from the hole 205. The flow of water may be provided to the cutting surfaces 170, 175, 180 and the surface 210 externally with a flow (not shown) introduced proximate to the core bit 110. Alternatively, the water flow can be provided to the cutting surfaces 170, 175, 180 and the surface 210 along internal cooling channels 195 extending longitudinally along the bit 110 (FIGS. 6A and 6B).

The user 100 can also releasably secure the drilling machine 105 to the surface 210 after locating the drilling machine 105 over the target location and prior to operating the drilling machine 105. For example, concrete anchor or anchors (not shown) can be inserted through the stand 116 (FIG. 1) and into the surface 210 or a vacuum plate can be attached to the stand 116 of the drilling machine 105 for releasable attachment to the surface 210. In another embodiment, the drilling machine 105 includes a stand 116 that is weighted to stabilize the drilling machine 105 at the target location during the drilling process. Other means of securing the drilling machine 105 to the surface 210 are contemplated.

A number of embodiments of the invention have been described. Nevertheless, it will be understood that various modifications may be made without departing from the spirit and scope of the invention. Accordingly, other embodiments are within the scope of the following claims.

What is claimed is:

1. A drill bit comprising:

a body having a distal end with a closed face and a proximal end, the body defining an axis and comprising a first portion adjacent to the proximal end, a second portion adjacent to the distal end, and an intermediate ring wherein the portions are substantially cylindrical, an outer diameter of the first portion is between about 1.9 and about 2.7 inches, an outer diameter of the second portion is between about 1.5 and about 2.1 inches, the intermediate ring extends radially outward circumferentially about the second portion, and a coupling at the proximal end, the coupling adapted for connection with a rotary driver, a depth stop adjustably secured to the first portion by a plurality of adjusting screws wherein the adjusting screws are substantially parallel to the axis, the depth stop being adjustably located between the first portion and the distal end circumferentially around the second portion in a manner to limit penetration of the bit, a plurality of springs located between and biasing the first portion from the depth stop, each spring of the plurality of springs being located circumferentially about one of the plurality of adjusting screws;

a primary cutting surface substantially located on the closed face, comprising a plurality of outer diamond cutter segments spaced around a circumference of the closed face and at least one inner diamond cutter segment extending across the closed face, a secondary cutting surface substantially located on the intermediate ring; and a pilot drill extending axially from the distal end of the body wherein the pilot drill is tipped by a cutter tip.

2. The drill bit of claim 1 wherein the depth stop is substantially disk shaped, with a stop outer diameter of about 2.5 inches and a stop inner diameter of about 1.9 inches.

3. The drill bit of claim 1 wherein the diamond cutter segments are water cooled.

4. The drill bit of claim 3 further comprising at least one internal cooling channel extending longitudinally along the bit.

5. The drill bit of claim 1 wherein the cutting surfaces comprise diamond.

6. The drill bit of claim 1 wherein the cutting surfaces comprise synthetic diamond.

7. A drill bit comprising:

a body having a proximal end and a distal end with a closed face, the body defining an axis and comprising a first portion adjacent to the proximal end, a second portion adjacent to the distal end, and an intermediate ring wherein the portions are substantially cylindrical, a first outer diameter of the first portion is greater than a second outer diameter of the second portion, and the intermediate ring extends radially outward circumferentially about the second portion;

a coupling at the proximal end, the coupling adapted for connection with a rotary driver;

a depth stop adjustably secured to the first portion by a plurality of adjusting screws wherein the adjusting screws are substantially parallel to the axis, the depth stop being adjustably located between the first portion and the distal end circumferentially around the second portion in a manner to limit penetration of the bit;

a plurality of springs located between and biasing the first portion from the depth stop, each spring of the plurality of springs being located circumferentially about one of the plurality of adjusting screws;

a primary cutting surface substantially located on the closed face, comprising a plurality of outer diamond cutter segments spaced around a circumference of the closed face and at least one inner diamond cutter segment extending across the closed face, a secondary cutting surface substantially located on the intermediate ring; and a pilot drill extending axially from the distal end of the body wherein the pilot drill is tipped by a cutter tip.

* * * * *